United States Patent [19]

Kroeter

[11] Patent Number: 4,519,458

[45] Date of Patent: May 28, 1985

[54] FLUE FIRE CONTROLLER

[75] Inventor: David W. Kroeter, Jonesboro, Ark.

[73] Assignee: Kroeter, Inc., Jonesboro, Ark.

[21] Appl. No.: 507,093

[22] Filed: Jun. 23, 1983

[51] Int. Cl.[3] ..... A62C 37/02

[52] U.S. Cl. ..... 169/56; 169/65

[58] Field of Search ..... 169/54, 56, 60, 61, 169/65, 19, 91

[56] References Cited

U.S. PATENT DOCUMENTS 2,297,808 10/1942 Soucy ..... 169/61

2,989,348 6/1961 Reed ..... 169/54 X

*Primary Examiner*—Andres Kashnikow

*Attorney, Agent, or Firm*—Hill, Van Santen, Steadman & Simpson

[57] ABSTRACT

A flue fire controller is provided which includes a temperature responsive valve between a source of pressurized fire retardant or extinguishing material and the interior of the flue pipe. When the temperature of the flue pipe increases to a level indicative of a flue fire, the valve automatically opens to allow the material to extinguish the fire. Means are also provided to close the valve after the temperature has dropped below the preselected value.

10 Claims, 3 Drawing Figures

FLUE FIRE CONTROLLER

BACKGROUND OF THE INVENTION

1. Field of the Invention

The present invention relates to automatic flue fire controllers and more specifically to temperature responsive flue fire extinguishers.

2. Brief Description of the Prior Art

Many homes and buildings have wood stoves, fireplaces and other such combustion units which are used for heating purposes or aesthetic purposes and which include flue pipes for the exhaust of combustion gases and by-products. Oftentimes the combustion process in the stove or fireplace is not complete and combustible materials are carried up the flue pipe along with the combustion gases. These combustible materials may be deposited on the interior walls of the flue pipe and after some period of time a sufficient amount of these materials are built-up on the flue pipe wall creating a fire hazard. If these combustible materials are not cleaned from the flue pipe walls, they can ignite causing a fire within the flue pipe itself which may result in the igniting of a portion of the building structure due to the close proximity of the structure with the flue pipe, for instance when the flue pipe passes through a wall or passes up between walls.

There generally is no protection provided for such flue fires and they often ignite the surrounding building materials before they extinguish themselves. Therefore, it would be a desirable improvement and advancement to provide a device which could automatically sense such a flue fire and extinguish it before it caused the building structure to ignite.

SUMMARY OF THE INVENTION

The present invention provides for an automatic flue fire controller which senses the flue temperature and causes an extinguishing material to be introduced into the flue if the flue wall reaches a predetermined danger temperature. The controller is comprised of a thermostatic switch which is in thermal contact with the flue pipe wall and which operates a solenoid valve if the temperature exceeds a predetermined level. A source of fire retardant or extinguishing material which is under pressure is piped to the solenoid valve and when the valve opens in response to a high temperature, the fire retardant or extinguishing material is injected into the flue pipe to extinguish the fire.

DESCRIPTION OF THE PREFERRED EMBODIMENTS

Figure 1:
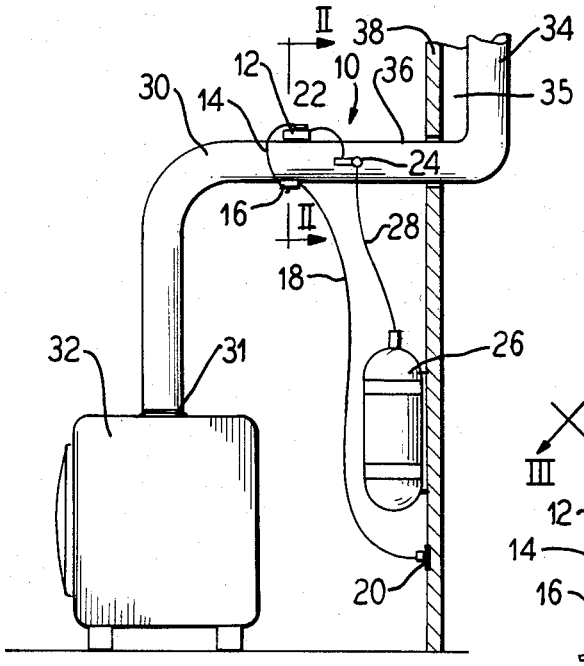
FIG. 1 is a schematic side view of a flue fire controller constructed according to the principles of the present invention and attached to the flue of a stove.
Figure 2:
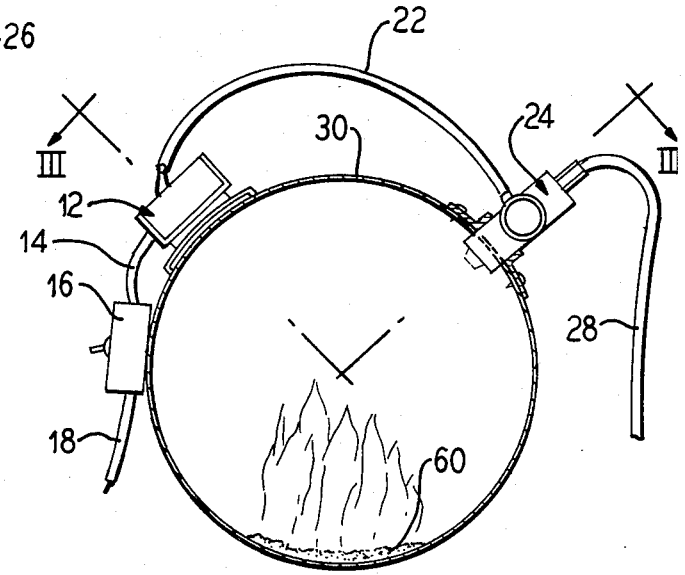
FIG. 2 is side sectional view through the flue pipe and of the flue fire controller taken generally along the lines II—II of FIG. 1.
Figure 3:
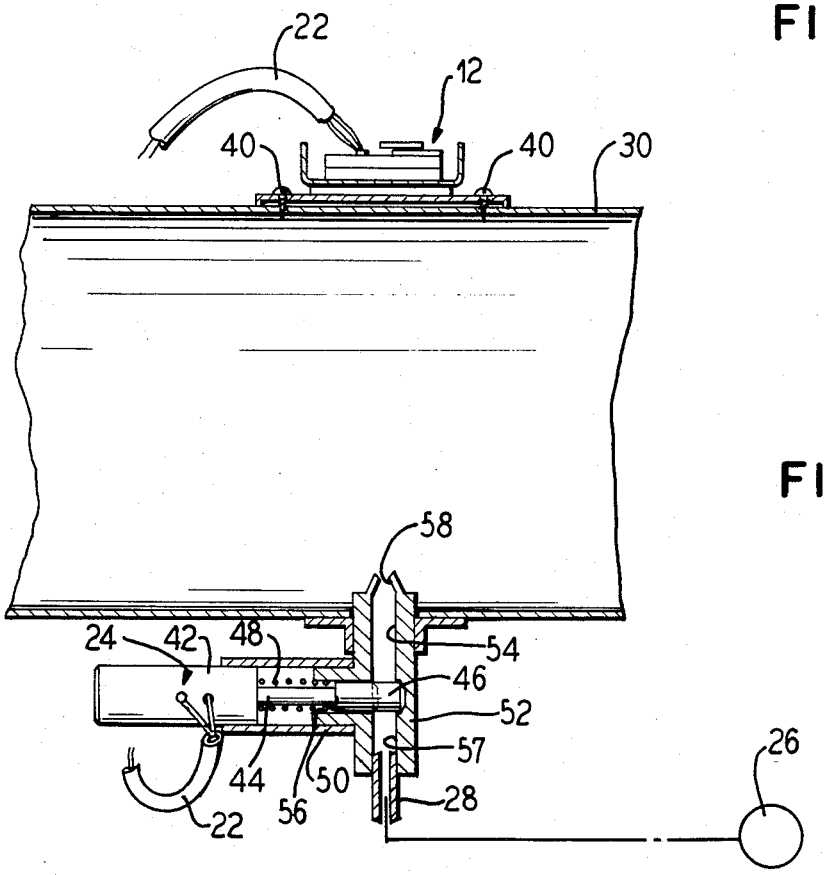
FIG. 3 is a side sectional view of the components of the flue fire controller of the present invention taken generally along the lines III—III of FIG. 3.

In FIGS. 1 through 3 there is shown a flue fire controller system generally at 10 which comprises a thermostatic switch 12 connected by electrical line 14 to a power supply switch 16 which is in turn connected by an electrical line 18 to a source of electrical energy shown in FIG. 1 as a wall electrical outlet 20. The source of energy could also be a battery pack or other auxilliary power supply.

The thermostatic switch 12 is also connected by an electrical line 22 to a valve means 24. A source of pressurized fire retardant or extinguishing material is provided and is shown in FIGS. 1 and 3 by the representation of a canister 26 which is connected by appropriate conduit 28 to the valve means 24.

The thermostatic switch 12 and valve means 24 are mounted on a flue pipe 30 which is connected at a bottom end 31 to a combustion chamber 32 such as a wood burning stove and which has a second end (not shown) which is at the top of a vertical section 34 of the flue 30 within a chimney area 35.

In the arrangement shown in FIG. 1, the flue fire controller system 10 is mounted on a horizontal section 36 of the flue pipe 30 on a portion of the flue pipe exposed within a room adjacent to a wall 38 of the building structure through which the flue pipe extends. Placement of the flue fire controller may be adjusted to suit the requirements of the particular installation. For instance, the thermostatic switch 12 and valve means 24 may be placed in the vertical section 34 of the flue 30 if there is a danger of high heat causing an igniting of the building materials at that point. Although the power switch 18 is also shown as being attached to the flue pipe, it can just as easily be positioned elsewhere, for instance on the wall 38, and the electrical wire 18 can also be mounted on or behind the wall.

Also, although the drawing in FIG. 1 shows use of a stove, for instance a wood stove which is a free standing unit positioned within a room, the present invention can also be utilized on stoves or fireplaces which are mounted in or behind the wall containing the chimney.

Details of the components of the flue fire controller system are shown in FIGS. 2 and 3 where it is seen that the thermostatic switch 12 is connected directly to the flue pipe 30, for instance by appropriate fastening means such as screws 40, so that there is a high degree of heat transfer between the flue pipe 30 and the thermostatic switch 12.

The valve means 24 includes a solenoid 42 having a plunger 44 with an enlarged head 46 which is biased outwardly by a spring 48. The solenoid 42 is mounted by appropriate tubing 50 onto a nozzle member 52 which has a central bore or passage 54 therethrough. An access opening 56 through the side of the central bore 54 is sized to receive the enlarged head 46 on the solenoid plunger 44 such that the head 46 blocks off the passage through the bore 54.

The conduit 28 which is connected to the source of fire retardant or fire extinguishing material from canister 26 is secured to communicate through an opening 57 in the bore 54 on an opposite side of the plunger head 46 from an opening 58 in the bore which extends into the interior of the flue pipe 30. Thus, the plunger head 46 functions as an effective valve seal within the bore 54 to prevent discharge of the fire retardant or extinguishing material through the opening 58 in the bore 54.

During normal operation of a wood stove or other combustion chamber, the combustion process may not be entirely complete and combustible materials may escape with the exhaust by-products and gases as they pass upwardly through the flue pipe. Some of these combustible materials may be deposited on the interior wall of the flue pipe 30 as is shown at 60 in FIG. 2. After a sufficient amount of these materials have been deposited, they may ignite due to the high temperatures within the flue pipe thus starting a fire within the flue pipe which would increase the temperature even higher.

Such an increased temperature is dangerous in that the flue pipe is usually positioned adjacent a portion of the building structure, such as by passing through the walls or by passing upwardly between the walls. This close proximity coupled with the high temperature of a flue with a fire therein can cause the adjacent building materials to ignite resulting in partial or complete destruction of the building. This is prevented by utilizing the flue fire controller of the present invention.

As the temperature within the flue pipe 30 increases due to a fire within the flue, the thermostatic switch 12 will activate upon the attainment of a preselected temperature. This will cause the solenoid 42 to be energized thereby moving the plunger 44 against the bias of spring 48 and causing the head portion 46 to withdraw from the bore 54. As this occurs, the passage through the bore 54 is cleared and the pressurized fire extinguishing or retarding material is then free to flow into the interior of the flue pipe 30 through the opening 58 in the bore resulting in the flue fire being extinguished. The opening 58 can be formed to present a spray of material into the flue pipe. As the temperature within the flue pipe drops below the preselected temperature setting on the thermostatic switch 12, the solenoid 42 is de-energized and the plunger head 44 is again reinserted into the bore 54 to prevent additional fire retardant or extinguishing material from entering the flue pipe 30.

Thus, it seen that there is provided a means for preventing damage caused by flue pipe fires which includes a means for controlling and extinguishing such fires in flue pipes.

As is apparent from the foregoing specification, the invention is susceptible of being embodied with various alterations and modifications which may differ particularly from those that have been described in the preceding specification and description. It should be understood that we wish to embody within the scope of the patent warranted hereon all such modifications as reasonably and properly come within the scope of our contribution to the art.

The embodiments of the invention in which an exclusive property or privilege is claimed are defined as follows:

1. A flue fire controller for use in conjunction with a thermally conductive flue pipe used for exhausting combustion by-products from a combustion chamber comprising:

a normally open temperature responsive electrical switch mounted on the exterior of said flue pipe in a thermally conductive manner, a source of fire retardant material under pressure connected by conduit means to a nozzle mounted on the exterior of said flue pipe and having an opening into said flue pipe, an electrical solenoid operated normally closed valve means energizable through said temperature responsive electrical switch, said normally closed valve means positioned in said conduit means between said nozzle opening and said source of fire retardant material, whereby a high temperature in said flue pipe will cause said temperature responsive switch to close, thereby energizing said solenoid, opening said valve means, and discharging said fire retardant material into said flue pipe.

2. The device of claim 1 including means for closing said valve means when said temperature in said flue pipe is below a preselected value.

3. The device of claim 1 wherein said fire retardant material is also fire extinguishing.

4. A fire controlling device for use with a thermally conductive flue pipe used for exhausting combustion byproducts from a combustion chamber comprising:

a source of fire retardant material under pressure connected by conduit means exterior of said flue pipe to an opening into said flue pipe, said conduit means terminating at said opening, a normally closed valve means positioned in said conduit means automatically responsive to the temperature of said flue pipe, whereby an increase in the temperature of said flue pipe above a preselected level will cause said valve means to open, thereby admitting said fire retardant material into said flue pipe.

5. The device of claim 4 wherein said valve means includes a thermally responsive switch mounted on the exterior of said flue pipe and a valve control means, said switch operating said control means causing it to open said valve means upon the attainment of said flue pipe preselected temperature.

6. The device of claim 5 wherein said valve control means is a solenoid.

7. The device of claim 5 including means for closing said valve means when said flue pipe temperature is below said preselected temperature.

8. The device of claim 5 wherein said thermally responsive switch is an electrical thermostatic switch.

9. A fire controlling device for use with a thermally conductive flue pipe used for exhausting combustion byproducts from a combustion chamber comprising:

a normally open electrical switch mounted on the exterior of said flue pipe to be responsive to the temperature of said flue pipe to automatically close when said flue pipe reaches a preselected elevated temperature, a source of fire retardant material under pressure connected by conduit means to a nozzle mounted on the exterior of said flue pipe and having an opening to the interior of said flue pipe, a valve means positioned in said conduit between said source of fire retardant material and said nozzle opening, and valve control means electrically connected to said electrical switch to open said valve means when said switch is closed and to close said valve means when said switch is open.

10. The device of claim 9 wherein said valve control means includes a spring biased solenoid.

* * * * *